US005269897A

United States Patent [19]

Menéndez et al.

[11] Patent Number: 5,269,897

[45] Date of Patent: Dec. 14, 1993

[54] INSTALLATION FOR REMOVING THE ZINC DEPOSITED BY ELECTROLYSIS ON ALUMINIUM PLATES

[75] Inventors: Franciso J. S. Menéndez, Alcobendas; Vicente A. Fernández, Madrid; Francisco A. Tamargo, Salinas; Fernando M. S. Menéndez, Salinas; Manuel P. López, Salinas; José M. M. Valdes, Arnao, all of Spain

[73] Assignee: Asturiana De Zinc, S.A., Spain

[21] Appl. No.: 737,965

[22] Filed: Jul. 30, 1991

[30] Foreign Application Priority Data

Aug. 1, 1990 [ES] Spain ..... 9002084

[51] Int. Cl.[5] ..... C25D 17/00

[52] U.S. Cl. ..... 204/226; 204/281; 204/227

[58] Field of Search ..... 204/198, 226, 286–289, 204/297 R, 281

[56] References Cited

U.S. PATENT DOCUMENTS

| | | | |
|---|---|---|---|
| 3,472,249 | 10/1969 | Jasberg | 134/46 |
| 3,847,779 | 11/1974 | Sekine et al. | 204/198 |
| 3,980,548 | 9/1976 | Sekine et al. | 204/297 R |
| 3,996,127 | 12/1976 | Rautimo et al. | 204/198 X |
| 4,131,531 | 12/1978 | Kaneko et al. | 204/198 X |
| 4,209,379 | 6/1980 | Freeman et al. | 204/198 |
| 4,288,312 | 9/1981 | Johnson et al. | 204/288 X |
| 4,304,650 | 12/1981 | Matsuo et al. | 204/281 X |
| 4,357,225 | 11/1982 | Arita et al. | 204/281 |
| 4,479,854 | 10/1984 | Willians et al. | 204/198 X |

FOREIGN PATENT DOCUMENTS

| | | |
|---|---|---|
| 3035019 | 4/1981 | Fed. Rep. of Germany . |
| 1326418 | 8/1973 | United Kingdom . |

*Primary Examiner*—Donald R. Valentine

*Attorney, Agent, or Firm*—Venable, Baetjer, Howard & Civiletti

[57] ABSTRACT

Installation for removing zinc deposited by electrolysis aluminum plates. The installation includes a storage zone for zinc cathode (1), a zinc scraping zone (2) and a storage zone (3) for zinc-free cathodes, the cathodes being displaced consecutively from one zone to another. The scraping zone (2) has a horizontally acting lateral piercer (22) that separates the upper edge of the sheets of deposited zinc from the cathodes, and a vertically acting scraping device (23) for removing all the zinc sheets.

On one of their vertical sides, the cathodes have an upper zone of lesser thickness to which is fixed coatings (76) of dielectric material, whose surface is coplanar with that of the cathode plate (70).

3 Claims, 11 Drawing Sheets

FIG. 6
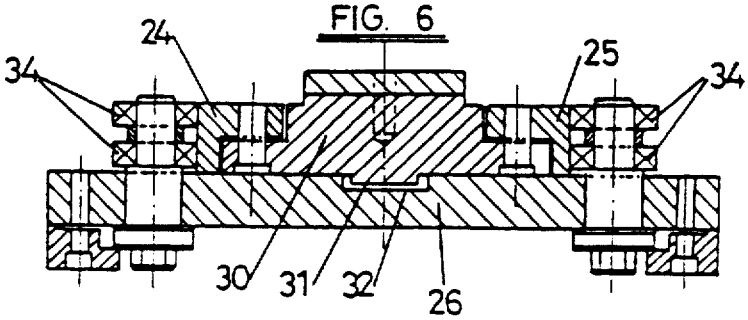
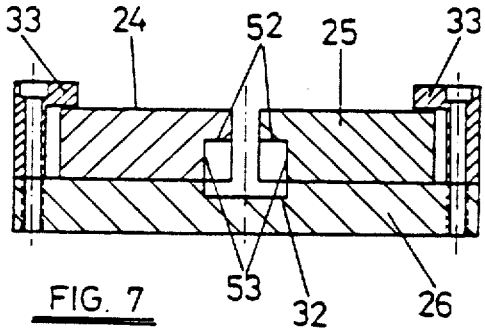
FIG. 7
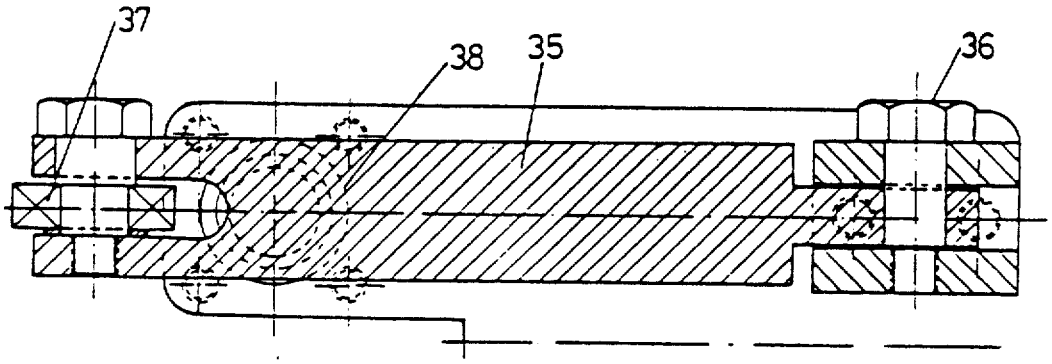
FIG. 8

FIG. 9
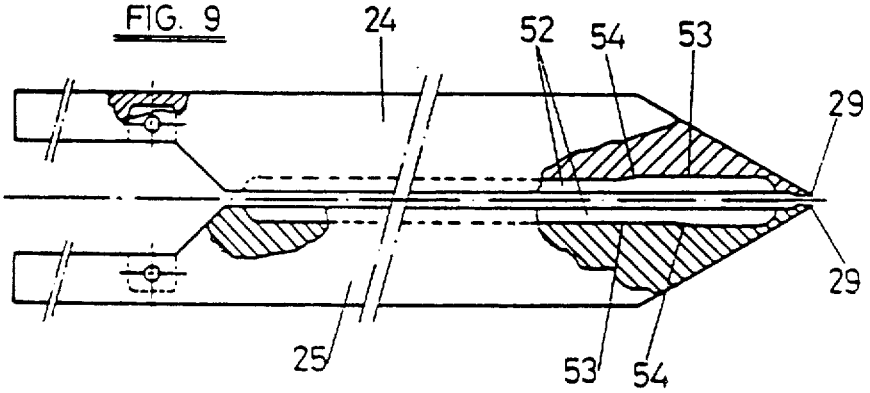
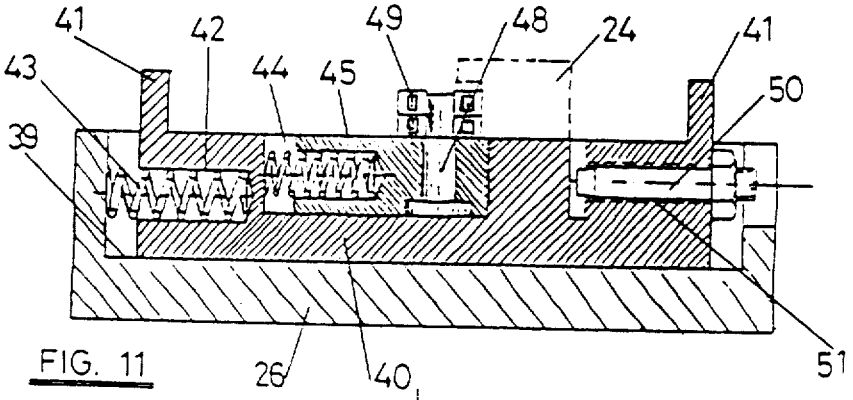
FIG. 11
FIG. 10
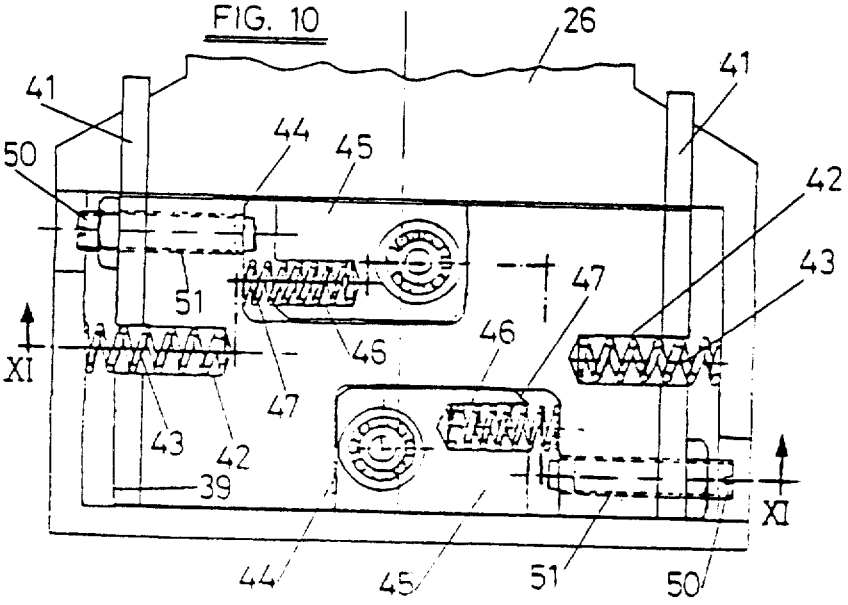

FIG. 15
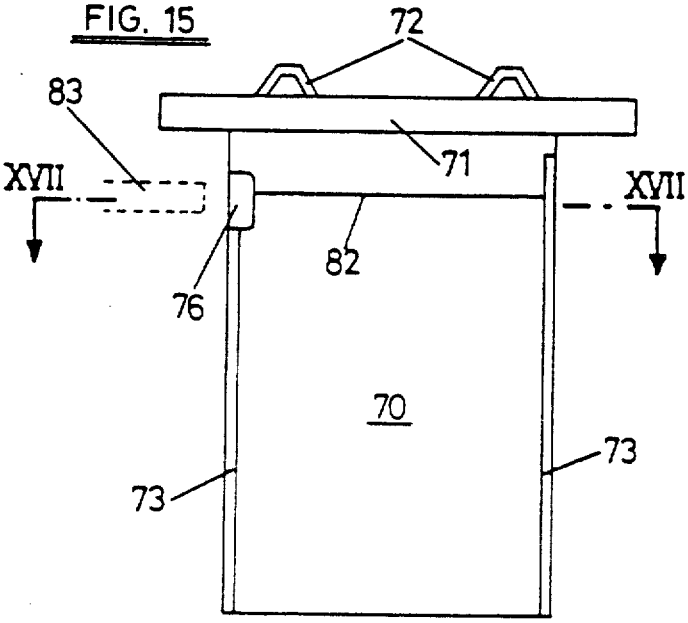
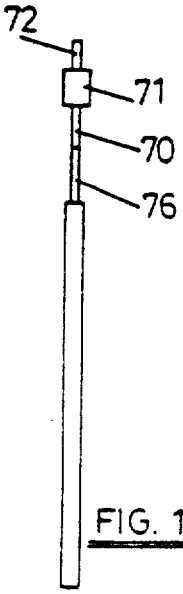
FIG. 16
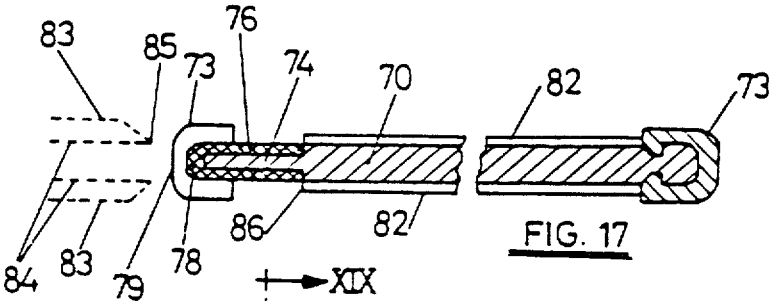
FIG. 17
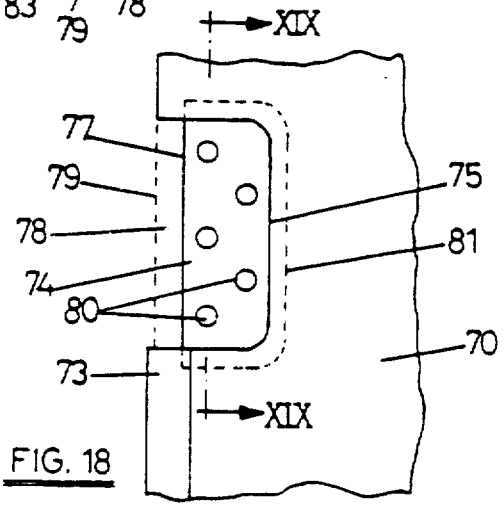
FIG. 18
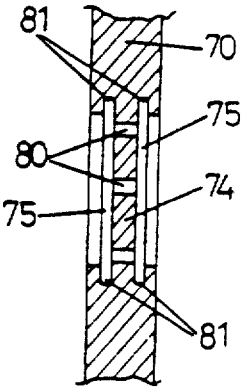
FIG. 19

INSTALLATION FOR REMOVING THE ZINC DEPOSITED BY ELECTROLYSIS ON ALUMINIUM PLATES

This invention concerns an installation for removing the zinc sheet deposited by electrolysis on aluminium plates used as cathodes in electrolytic cells. The installation is designed in such a way that allows this removal to be carried out efficiently and without any deterioration occurring in the cathodes.

In the production of zinc by electrolysis, plane cathodes are used consisting of an aluminium plate that is introduced vertically into the electrolytic cells. The upper edge of this plate is fitted with a bar of length greater than that of the edge itself and serving as a head for support, as a current terminal and for maneuvring the cathode. The vertical sides of the aluminium plate are generally covered with a protective surface of dielectric material to prevent zinc from being deposited along them.

In the electrolysis process, the zinc is deposited on the free surfaces of the aluminium plate up to the height at which this plate is submerged in the cell.

The zinc sheet deposited on the cathodes adheres very strongly to the surface of the aluminium plate. There are well-known devices for detaching these layers, including two vertical and appreciably parallel blades separated from each other by a distance slightly greater than the thickness of the cathode plates. The lower part of these blades is finished with sections that converge together and are themselves finished with edges that have an angular cross-section. In order to proceed to remove the sheets of zinc from each cathode with this device, one blade is used on each surface of the cathode, supporting and pressing the edge of the blades against these surfaces at above the height reached by zinc deposits. The blades are then displaced in a downward direction in such a way that they meet the deposited zinc sheet and detach it from the cathode.

The inconvenience of this system is that the blades corrode the cathode surfaces, rendering them useless after a relatively low number of operations. Due to the high cost of the cathodes, in the end this removal system for the zinc is not appropriate.

Attempts have been made to solve the problems mentioned above by means of a system that includes two successive phases of acting on the cathodes. In the first phase, the removal of the upper level of the deposited zinc sheets is carried out by means of a horizontally acting lateral piercer, and in the second phase, the zinc sheets are completely scraped off by means of two vertical blades. The lateral piercer consists of two horizontal arms that have an acting end with a vertically wedge-shaped edge. The arms can be displaced axially, one on each side of the cathode, at the height of the upper level of the zinc deposit. During the displacement of these arms, the acting end of the arms is pressed against the cathode surfaces, causing erosion and deterioration in this zone.

In order to facilitate the action of the lateral piercer, cathodes are known by U.S. Pat. No. 3,980,548 which are fitted with a swivelling piece in the upper part of one of the vertical sides. These pieces, which are made of dielectric material, are located at the height reached by the electrolyte in the cell. They have a channelled shape and clasp the cathode plate, to which they are secured by means of a perpendicular shaft. The piece swivels on this shaft between a lower position and an upper position. In the lower position it couples with and covers a certain zone of the plate as an extension of the protective coverings of the vertical sides, thereby preventing the zinc from being deposited in that zone during the electrolysis process. When the swivelling piece is in the upper position this zone is left free and exposed, allowing the arms of the lateral piercer to back onto the surfaces of the cathode plate in this zone and, as they continue their advance, they meet the face of the zinc deposit and cause it to be removed.

These cathodes have a fundamental problem, deriving from the need of having to cause the swivelling piece to rotate from the lower to the upper position every time that the zinc deposits are to be removed.

When the cathode is introduced into the cell the swivelling piece has to be in the lower position. The rotating of the piece and the conditions to which it is subjected causes the adjustment between this piece and the cathode, and fundamentally of the rotating shaft, to be lost and become deteriorated in a relatively short period of time. It is then necessary to lift up the swivelling piece by hand during the operation of scraping off the zinc. The process consequently becomes more costly on account of the manual labour involved.

Moreover, the vertical blades are fixed-position with regard to the support from which they are suspended. This requires that the separation between the blades has to be adjusted with precision in order to prevent erosion of the cathode surfaces.

This scraping system is carried out by means of an installation that includes a storage zone for cathodes with the zinc layers attached to them, a zone for scraping off these layers, where the lateral piercer and the vertical blades are located, and a storage zone for the cathodes that are free of zinc sheets. The cathodes are displaced along the zones occupying successive parallel positions.

The purpose of the invention that is discussed here is to develop an installation by means of which the sheets of zinc deposited on the cathodes can be removed without producing any deterioration in these cathodes, or with minimal deterioration, thereby extending their life.

Another purpose of the invention is to produce an automatically operating installation with which the zinc sheets can be removed from the cathodes automatically and synchronized with the process of scraping off the zinc sheets.

A further purpose of the invention is to develop a cathode that lacks moving parts and which is provided with a zone adjacent to one of the vertical sides of the cathode plate, and at the height reached by the lateral piercer of the zinc scraping installation, where zinc is not deposited during the electrolysis process.

There being no moving parts, the construction of the cathode becomes simplified and the risk of its deteriorating prematurely is eliminated.

Moreover, the invention's cathode ensures that the contour and position of the zone that must remain free of zinc deposits is maintained in such a way that the action of the lateral piercer is initiated automatically without any need for manual intervention at all.

As with the installation that uses the scraping system mentioned above, the installation of the invention includes a storage zone for cathodes carrying the sheets of zinc deposited on them, a zone for scraping off the zinc from the cathodes, and a storage zone for cathodes that are free of deposited zinc. These cathodes can be displaced along these three zones, occupying successive parallel positions.

In the scraping zone, the invention's machine is also fitted with a lateral piercer in order to separate the upper edge of the zinc sheets from the cathodes, and a scraping device for fully removing these sheets. The lateral piercer consists of two horizontal arms, parallel and located close to each other. These can be displaced longitudinally and are located so that they face one of the positions occupied by the cathodes in the scraping zone, one on each side of the cathode and at the height of the upper edge of the zinc sheets. These arms have an acting face with a vertical wedge-shaped edge. The scraping device consists of two vertical blades located immediately next to the piercer in a position facing one of the positions occupied by the cathodes in the scraping zone. One blade is located on each side of the cathode, and the two blades can be displaced vertically between an upper position, where they are above the scraping zone, and a lower position, where they are approximately at the height of the lower edge of the cathodes.

Starting from the construction mentioned above, the invention's installation is characterized basically by the mechanism for advancing or displacing the cathodes along the storage and scraping zones, by the special assembly of the arms of the lateral piercer in order to prevent these arms from causing the cathode plates to deteriorate, and by the assembly system for the vertical blades of the scraping device in order to ensure that these blades act without causing any deterioration at all in the cathode surfaces.

In accordance with the invention, each of the storage and scraping zones includes two fixed and two movable bars of equal lengths. The fixed bars run along the top of each zone, in a horizontal and parallel position and at the same height, being separated by a distance slightly greater than the width of the cathode plates. The movable bars back on to the outside of the fixed bars and are linked by means of a mechanism that will allow the cathodes to advance synchronously. Both the fixed and the movable bars have upper equidistant facing notches sized in order to receive the ends of the cathode heads. The movable bars can be displaced alternatively in the same direction with a combined movement: in the vertical direction by an amount slightly greater than the height of the notches and in the longitudinal direction by an amount equal to the distance between consecutive notches. With this combined movement of the movable bars, the cathodes supported on the movable bars can be sequentially displaced.

The means of actuating the movable bars consist of horizontal motors or hydraulic cylinders that act directly on these bars by means of flexed vertical rods. These flexed rods are coplanar with the movable rods and are linked by the flexing of a fixed point. The lower arm of the flexed rods is linked to the cylinder, while the free end of the upper arm carries a freely rotating wheel supporting the movable bar. With this construction, when the mechanism is at rest, the upper notches of the movable bars match up with the notches of the fixed bars, with the cathode heads resting on these. When the mechanism is activated, the movable bars cause these heads to lift up and advance, which pulls the cathodes and causes them to advance one position or notch, into which the movable bars descend in order to locate the cathodes again in the notches of the fixed bar in their more advanced position. The movable bar returns to the initial position in which it started.

By this means, the movable bars in the storage and scraping zones achieve a sequential advance of the cathodes, in a synchronized manner.

In the scraping zone, the notches of the fixed bar determine the positions in which these cathodes will be acted upon by the lateral piercer and the vertical blades.

In accordance with the other essential characteristic of the invention, the arms of the lateral piercer are mounted on a table that includes longitudinal guides for guiding the displacement of the blades. It also includes adjustable stops that fix the separation of the blades at the start of their displacement, and the means for varying this separation during the displacement of the arms. At the start of their displacement, the adjustable stops maintain the arms at a separation approximately equal to the thickness of the aluminium plate of the cathode. The means for varying the separation of the arms are then activated so that the separation is slightly increased during the whole of the horizontal displacement of the arms over the cathodes, in such a way that there is no risk of erosion or deterioration of the cathode surfaces.

The table carrying the arms of the lateral piercer consists of a platform, on which are mounted two longitudinal strips and two lateral rollers that act as external guides to limit the maximum separation of the piercer arms. Also mounted on this platform is a central rear hydraulic cylinder responsible for the longitudinal displacement of the arms, and a forward support on which are mounted the stops that fix the initial separation of the arms and the means of varying this separation.

The invention's installation is further characterized by the vertical blades of the scraping device being suspended by means of horizontal shaft linkages that allow the blades to swivel partially; also by two heads whose lower ends are connected to or suspended from other actuating upper vertical hydraulic cylinders; and by upper vertical guides that ensure uniform displacement of the blade.

Turning to the cathode developed by this invention, this is characterized by the fact that the aluminium plate is provided with a zone of lesser thickness made starting from one of its two vertical sides, which are perpendicular to the upper bar. This zone of lesser thickness is shaped by recesses with matching contours, and preferably of equal depth, made in the two surfaces of the plate. These recesses can be made mechanically and are located at such a height that the upper and lower edges of the contour of the recesses respectively lie above and below the maximum and minimum heights to which the plate is immersed in the electrolytic cell.

The recesses made in the two surfaces of the plate are totally filled with an anti-acid dielectric material, this layer of filling being equal to the height of the recesses so that the plane surfaces of the coatings are coplanar with the surfaces of the plate.

This coating can be attached to the surface of the recesses by means of an adhesive, which should also be resistant to the acid electrolyte and to the heat generated in the cathode when the zinc is being deposited. The two layers of filling material can also be fixed by joining these layers via through passage holes made from the back of the recesses and using anchoring points in the edges of the filling layers to the walls of the recesses, etc.

The coatings that cover the two recesses will also be joined together on the vertical side of the plate, being left in this zone as an extension of the dielectric material pieces that cover the vertical sides of the cathode plates.

All the characteristics stated here, as well as others belonging to the invention as included in the patent claims, are explained below in greater detail and with the help of the attached drawings, which show a preferred embodiment of the invention.

In the drawings:

FIG. 6 is a transverse cross-section, on a larger scale, along the line VI—VI of FIG. 4.

FIG. 7 is a transverse cross-section, on a larger scale, along the line VII—VII of FIG. 4.

FIG. 8 is a larger scale cross-section along the line VIII—VIII of FIG. 4.

FIG. 9 is a plan view of the arms of the lateral piercer.

FIG. 10 is a partial plan view of the lateral piercer table, in which the arms of the piercer have been removed.

FIG. 11 is a cross-section along line XI—XI of FIG. 10.

FIG. 15 is a side elevation of a cathode designed in accordance with the invention.

FIG. 16 is a profile view of the cathode in FIG. 15.

FIG. 17 is a larger scale cross-section along the line XVII—XVII of FIG. 15

FIG. 18 is a larger scale detail showing the side elevation of the offsetted zone of the cathode.

FIG. 19 is a cross-section along line XIX—XIX of FIG. 18.

Figure 1:
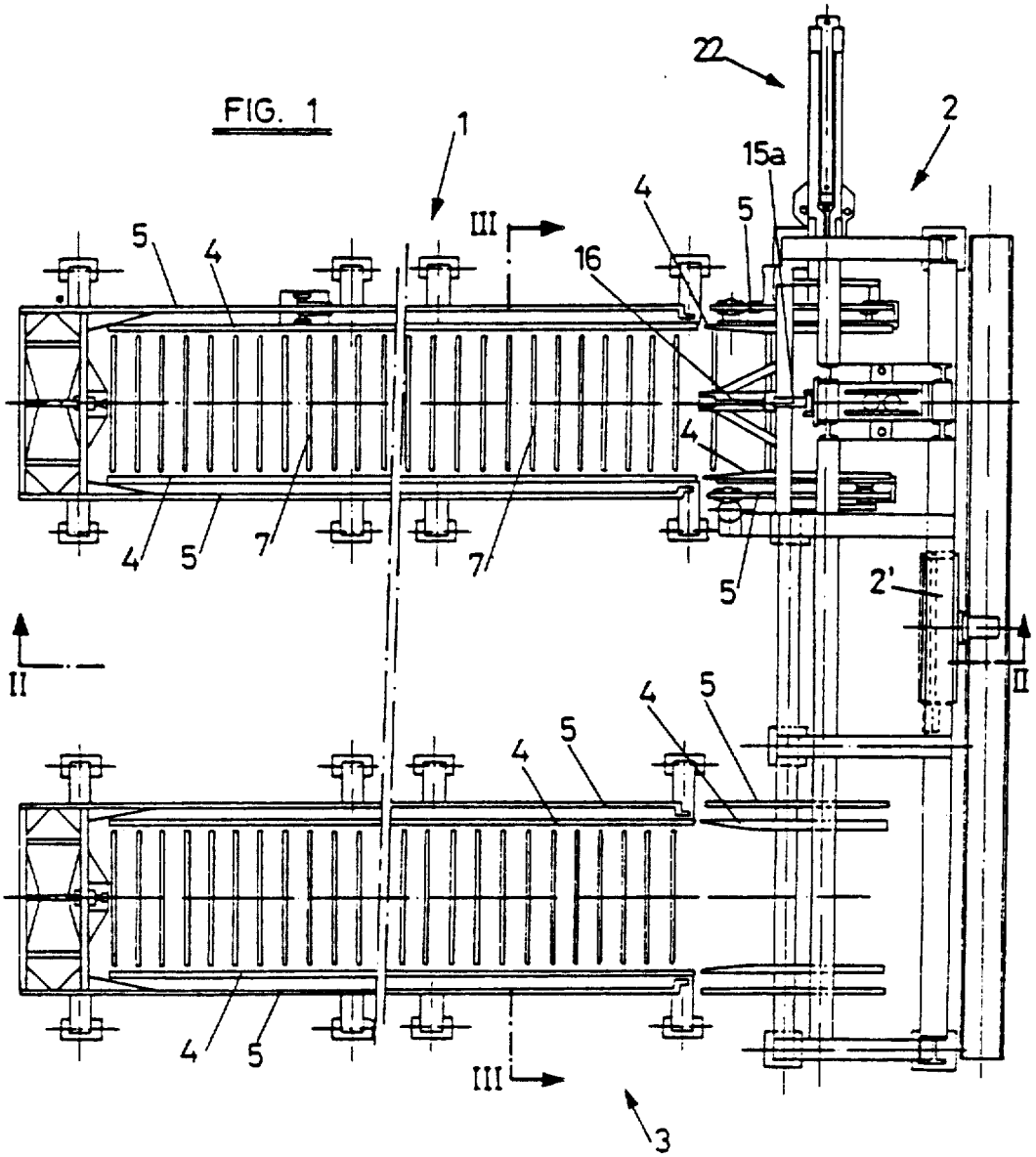
FIG. 1 is a plan view of an installation designed in accordance with the invention.
Figure 2:
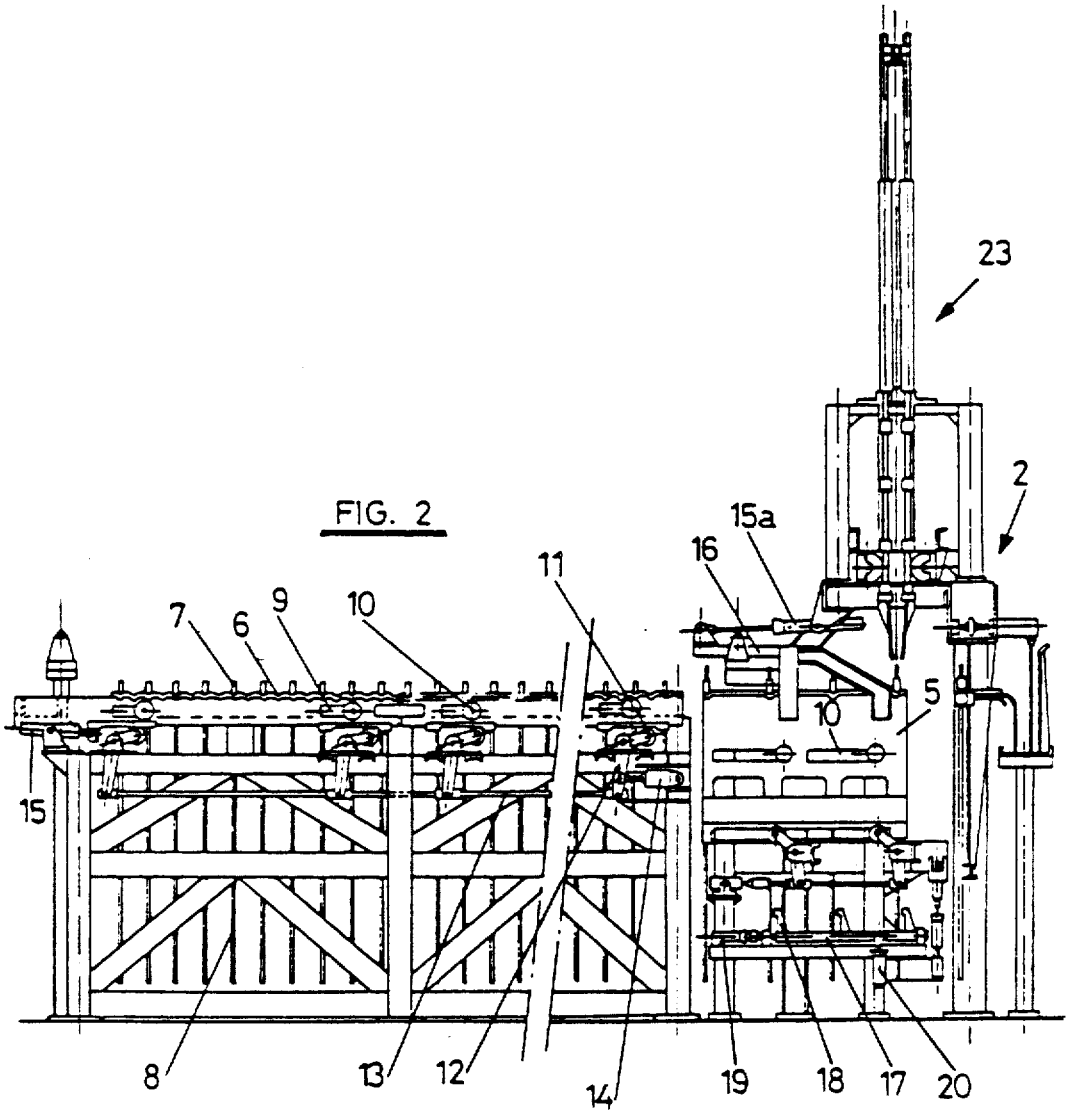
FIG. 2 is a cross-section along the line II—II of FIG. 1.
Figure 3:
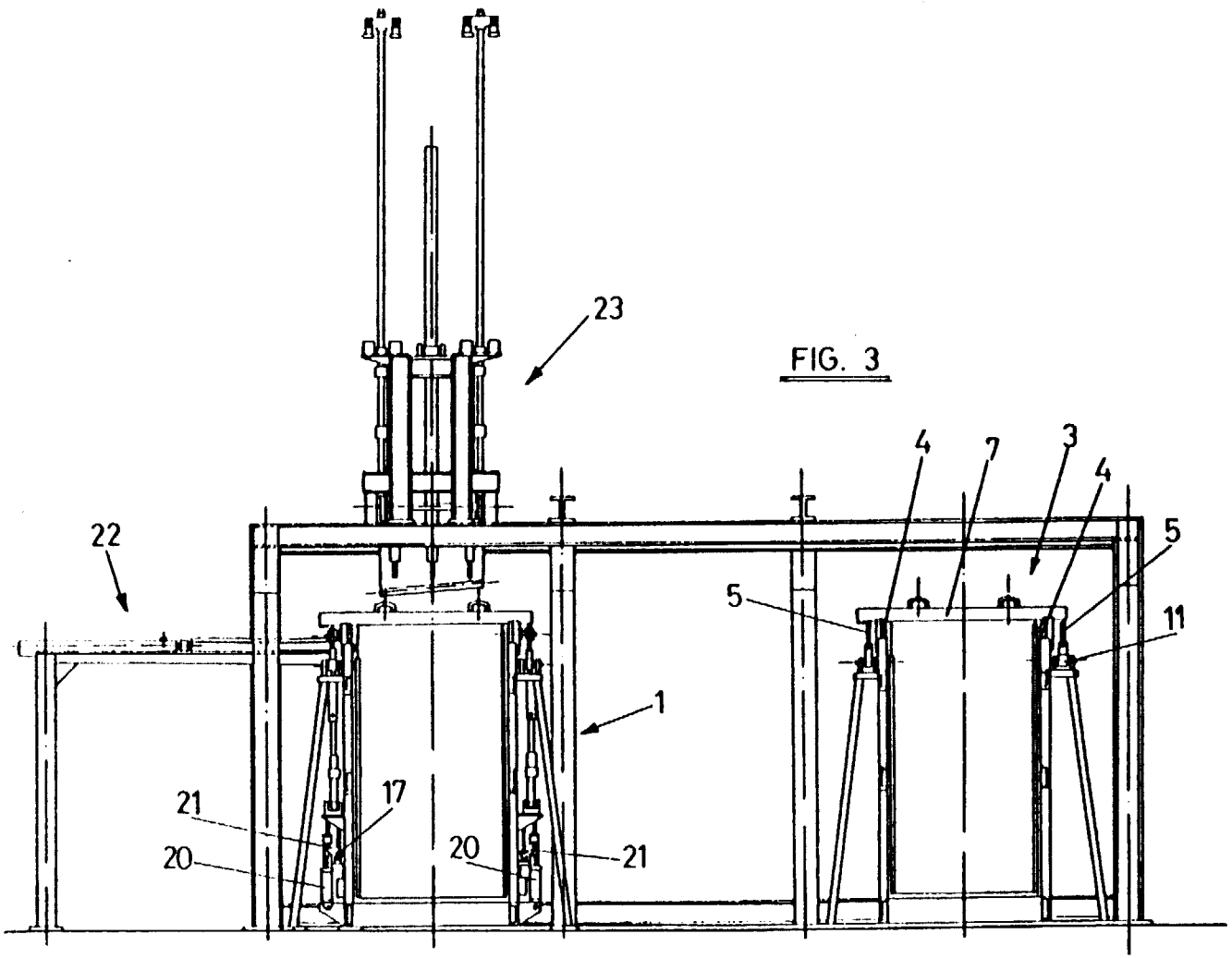
FIG. 3 is a cross-section along the line III—III of FIG. 1.

The installation shown in FIGS. 1, 2 and 3 includes a storage zone for cathodes with zinc deposited on them, this zone being referenced with the number 1, a scraping zone for the zinc sheets of the cathodes, referenced with number 2, and a storage zone for cathodes free of zinc sheets, referenced with the number 3.

These three zone are provided with the means for consecutive and synchronous displacement from storage zone 1 to the scraping zone 2, and from here to storage zone 3. The cathodes with zinc deposits are supplied to storage zone 1 by means of a crane which takes them from the electrolytic cells. In the same way, the empty cathodes are taken by the crane from storage zone 3 to be introduced again into the electrolytic cells.

Each of the zones 1, 2 and 3 are limited by two fixed bars or beams, referenced with number 4, and two movable bars or beams, referenced with number 5. The fixed bars run along the top of each zone in a horizontal and parallel position and are separated from each other by a distance slightly greater than the width of the cathode plates, but less than the length of the head that tops these cathodes. The movable bars 5 are arranged along the outside of the fixed bars 4, close to them and located at a height slightly lower than these fixed bars. Both the fixed and the movable bars have equidistant notches 6 along their upper side, located in a position facing the four bars of each zone. These notches are sized in order to receive the extreme ends of the heads 7 of the cathodes 8.

The movable bars 5 can be displaced alternatively in the same direction in all zones with a combined vertical and longitudinal movement. Displacement in the vertical direction is through a distance slightly greater than the height of the notches 6, while displacement in the longitudinal direction is through a distance equal to the distance between consecutive notches. In the lifting movement, the movable bars are raised up above the upper side of the fixed bars, receiving the support of the heads 7 of the cathodes and lifting up all the cathodes of the fixed bars. The longitudinal movement of the movable bars from their raised position causes the advance or displacement of all the cathodes by an amount equal to the separation between consecutive notches 6. When the movable bars descend after having advanced, they deposit the heads of the cathodes 7 into the notches of the fixed bars, after having advanced one place over them. Once they have descended, the movable bars 5 retract to their original position in order to begin a new cycle of advance.

The movable bars 5 are supported by the fixed bars 4. For this, the movable bars 5 are provided with longitudinal notches 9, via which protrude rods or arms 10 linked to the fixed bars 4 and which have a head or an enlargement at the end, of a size greater than the height of the grooves 9. These grooves are of a sufficient dimension to allow the longitudinal and vertical displacement of the movable bars 5.

Actuation of the movable bars 5 is carried out in each of the zones by means of motors or hydraulic cylinders.

In storage zones 1 and 3, as can be seen in FIG. 2, the movable bars 5 are supported underneath by freely rotating wheels 11 that are mounted on the upper end of flexed rods, linked to a fixed point via a flexing zone. All the rods 12 are connected by their lower ends to a longitudinal bar 13. One of the rod ends 12 is also connected to an actuating hydraulic cylinder by means of an intermediate point on its lower arm. With this arrangement, when the hydraulic cylinder 14 is withdrawn it causes all the rods 12 to rotate, raising up the freely rotating wheel 11 and, with that, lifting up the bar 5. When the hydraulic cylinder 14 acts in the opposite direction, it causes the freely rotating wheel 11 to descend, as does the movable bar 5. The longitudinal displacement of the movable bar 5 is achieved by means of the hydraulic cylinder 15 acting directly on this bar.

In the scraping zone 2, the same actuating system is used, the cylinder 15*a* being responsible for the longitudinal displacement of the movable beam 5. The cylinder is located above this beam and connected to it by means of an intermediate structure 16.

In the installation shown in FIGS. 1 to 3, the storage zones I and 3 are parallel. Nevertheless, zone 3 could be located as a continuation of zone 2, lining up with storage zone 1. In the arrangement shown in the diagrams, there is a carriage 2' between the scraping zone 2 and storage zone 3. This carriage is responsible for displacing the empty cathodes from the scraping zone 2 to storage zone 3.

Below the movable beams 5 in the scraping zone 2 are longitudinal shafts 17 provided with radial lugs 18. These shafts are connected to a horizontal cylinder 19 that allows the shaft 17 to be displaced, and are also connected to a vertical cylinder 20 via a rod 21, which causes the shaft to turn partially by an amount sufficient to displace the radial lugs 18 towards the interior of the scraping zone. The aim is for them to act as securing elements to hold the cathodes in their correct position when these are located above the notches of the fixed beams. The rotating movement of the shaft 17 in the proper direction allows the lugs 18 to act as stabilizing stops for the cathodes. Once this has been achieved, the shaft 17 is displaced axially by means of the cylinder 19 in order slightly to separate the lugs 18 of the cathodes. The shaft 17 is then turned in the opposite direction to withdraw the lugs 18 to the vertical position shown in FIGS. 2 and 3. This thereby prevents possible damage to the cathodes or to the protective coatings covering their vertical sides.

The scraping zone 2 is provided with a lateral piercer 22 responsible for separating the upper edge of the zinc sheets deposited on the cathodes, and a scraping divide 23 for removing all these sheets.

The design of the lateral piercer will be explained with reference to FIGS. 4 to 11.

Referring first to FIGS. 4 to 8, the lateral piercer consists of two equal horizontal arms, referenced with numbers 24 and 25, mounted with the ability to be longitudinally displaced along a table 26. These arms are connected to a rear actuating hydraulic cylinder 27 and their forward ends have the shape of a wedge 28 that defines the extreme vertical tapered edges 29. The piercer 22 is located in a position facing one of the positions occupied by the cathodes in the scraping zone, in such a way that the arms 24 and 25 are located one on each side of this cathode. The piercer 22 is also situated at a height such that the tapered edges 29 of the arms 24 and 25 are at the height of the upper edge of the zinc sheets stuck to the cathodes.

Figure 4:
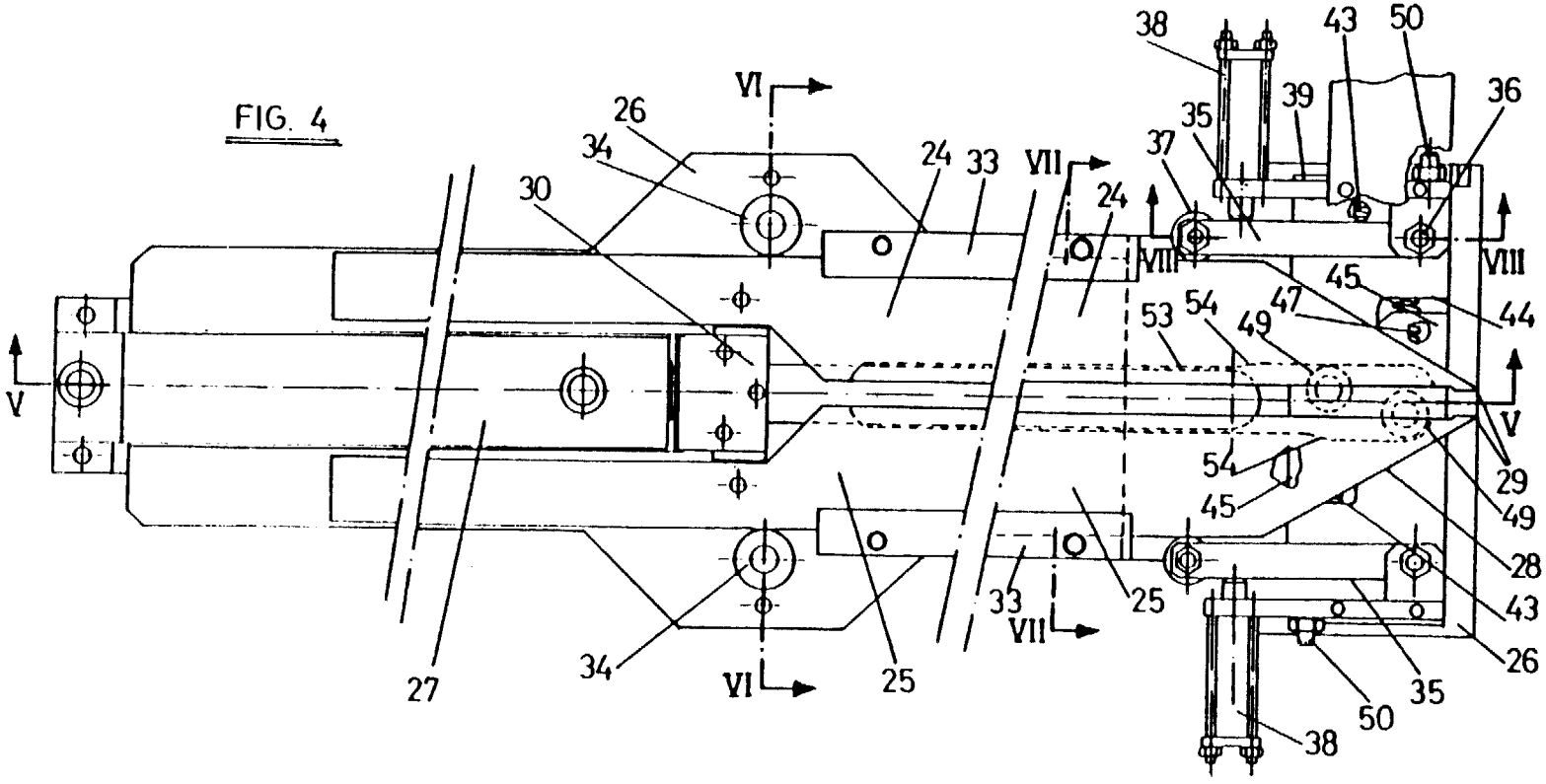
FIG. 4 is a plan view of the lateral piercer.
Figure 5:
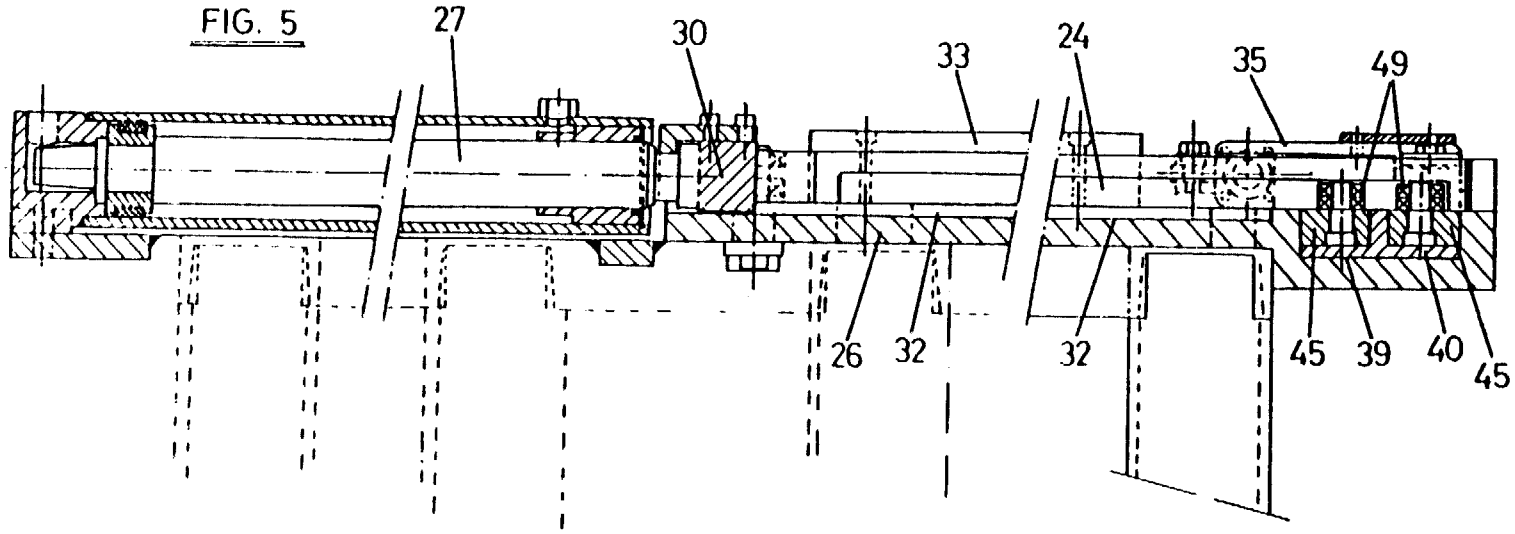
FIG. 5 is a longitudinal cross-section of the lateral piercer, taken along the line V—V of FIG. 4.

As can be seen in FIGS. 4 to 6, the rod of the cylinder 27 is connected to a transverse head 30, the ends of which are connected to the arms 24 and 25. This head has a lower protuberance 31 that can be displaced along a longitudinal channel 32 formed in the table 26. In order to guide the longitudinal displacement of the arms 24 and 25, the table 26 also has fixed longitudinal guides 33 and freely rotating rear rollers 34.

As can be seen in FIGS. 4, 5 and 8, mounted on the forward part of the table are two lateral pushrods that drive the arms 24 against each other. Each of these pushrods consists of a rod 35 linked by one of its ends 36 to a fixed point, while the other end has a freely rotating roller 37 supported against the adjacent arm. Acting on the rod 35 is a cylinder 38, whose action causes the blades 24 and 25 to approach each other.

As can be seen in FIGS. 4, 5, 10 and 11, the table 26 forms an enlargement in its forward part in which, starting from its upper surface, an offset or slot 39 is created in which is mounted a support 40 This support consists of a flat piece of width approximately equal to that of the slot 39 but with length slightly shorter, so that this piece is limited in its upper part by two transverse dividers 41 of length greater than the width of the support. Starting from the transverse sides, the support has two facing blind drill-holes 42 which house compression springs 43 supported against the shorter walls of the slot 39. These serve as centralizing elements for the support 40.

The upper surface of the support 40 has two intermediate slots 44, each of which opens into one of the longitudinal sides of the support. These two slots are slightly out of phase with each other in the longitudinal direction of the support. Each of these slots has a centralizer 45. Each centralizer consists of a piece that is appreciably flat, with a rectangular contour and of width approximately equal to that of the slots 44 but with length shorter than these. Starting from a the side facing outwards, the centralizers 45 have a blind drill-hole what houses a compression spring 47 supported against the opposite wall of the slot 44. Between their larger surfaces, the centralizers 45 also have a drill-hole 48 for mounting a freely rotating roller 49, FIGS. 10 and 11, for adjusting the separation of the blades 24 and 25, as will be explained below.

The position of the centralizing pieces 45 can also be adjusted by means of a threaded rod 50 that penetrates an opening 51 made in the transverse sides of the support 40 and which protrudes to the outside via a hole or opening made in the wall limiting the slot 39 in the table. Mounted on the ends of the dividers 41 of the support 40 are cylinders 38 that act on the rods 35 responsible for moving the arms together.

As can be seen in FIGS. 7 and 9, the lower surface and adjacent sides of the arms 24 and 25 have offsets or recessed steps 52 that house the freely rotating rollers 49, defining the external vertical wall 53 of these offsets as rolling tracks for the rollers 49. The offsets 52 vary in width along a section 54, causing the blades to become axially out of phase by a distance equal to the separation distance between the rollers 44. As can be seen in FIG. 4, the rollers 49 act on the track of the opposite arms.

With the design mentioned here, for the arms 24 and 25 to act on the cathodes, and starting from the position shown in FIG. 4, the two arms begin to be displaced without the cylinders 38 being actuated until the sides 29 of the arms become located over the cathode plate, one arm on each side, at the start of that plate. At that moment, the cylinders 38 are actuated and the arms 24 and 25 move together in such a way that the edges 29 are supported on the surfaces of the cathode. The maximum distance of separation between the arms 24 and 25 is regulated by the links or threaded rods 50. Advancing in this position, the sides 29 of the arms start to scrape off the zinc sheets deposited on the cathode. During this advance, when the rollers 49 reach the ramps 54 of the tracks 53 on which these rollers are supported, the arms 24 and 25 are caused to separate slightly in such a way that the front sides 29 of the these arms no longer rest upon the surface of the cathodes. From that moment on, the rapid advance of the arms 24 and 25 can be achieved, causing the zinc sheets to be detached without scratching the surfaces of the cathodes. At a certain moment during the progress of the arms along the cathode, which can be regulated as wished, the action of the cylinders 38 can be cut out, with which the springs 47 push against the pieces 45, forcing the arms 24–25 to become separated.

Thanks to the existence of the springs 43 and 47, the self-centring of the blades 24 and 25 over the cathodes is achieved, even when these blades start to deviate over the cathodes.

With the system of centring the arms 24 and 25 and moving them closer together, correct action is indeed achieved on the cathode for removing the upper part of the zinc deposits and preventing erosion or deterioration of the cathodes.

Figure 12:
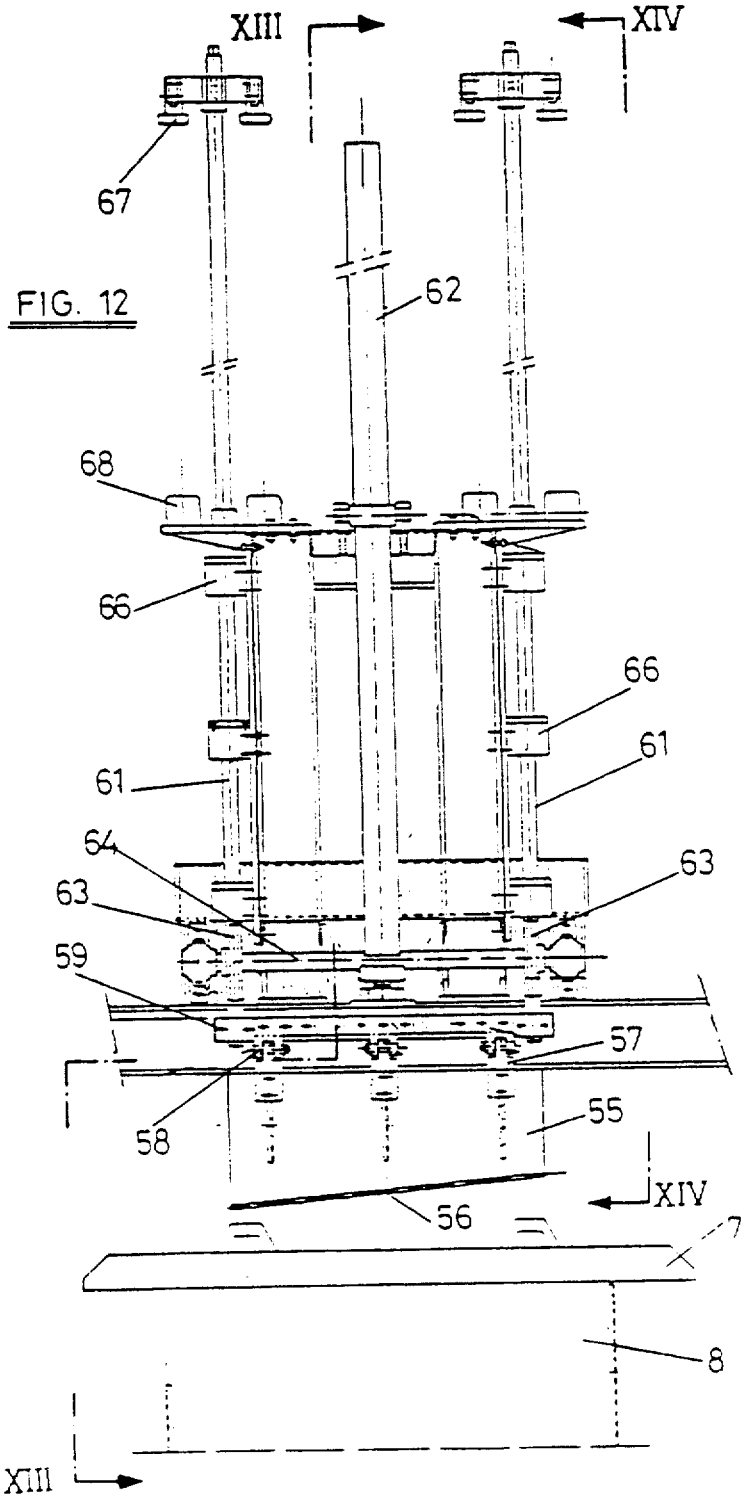
FIG. 12 is a front elevation of the scraping device, in a view similar to that of FIG. 3.
Figure 13:
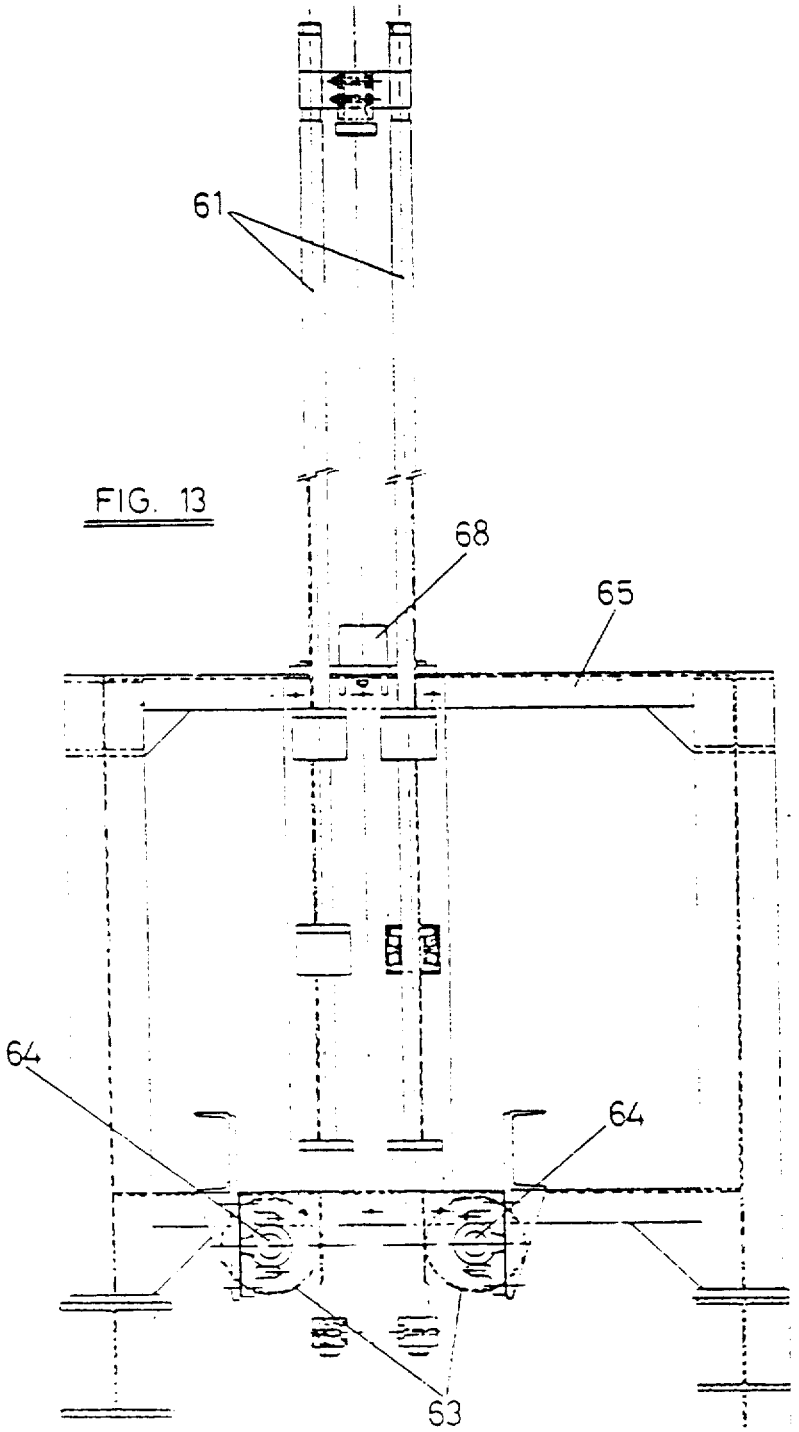
FIG. 13 is a side view of the scraper, along line XIII—XIII of FIG. 12.
Figure 14:
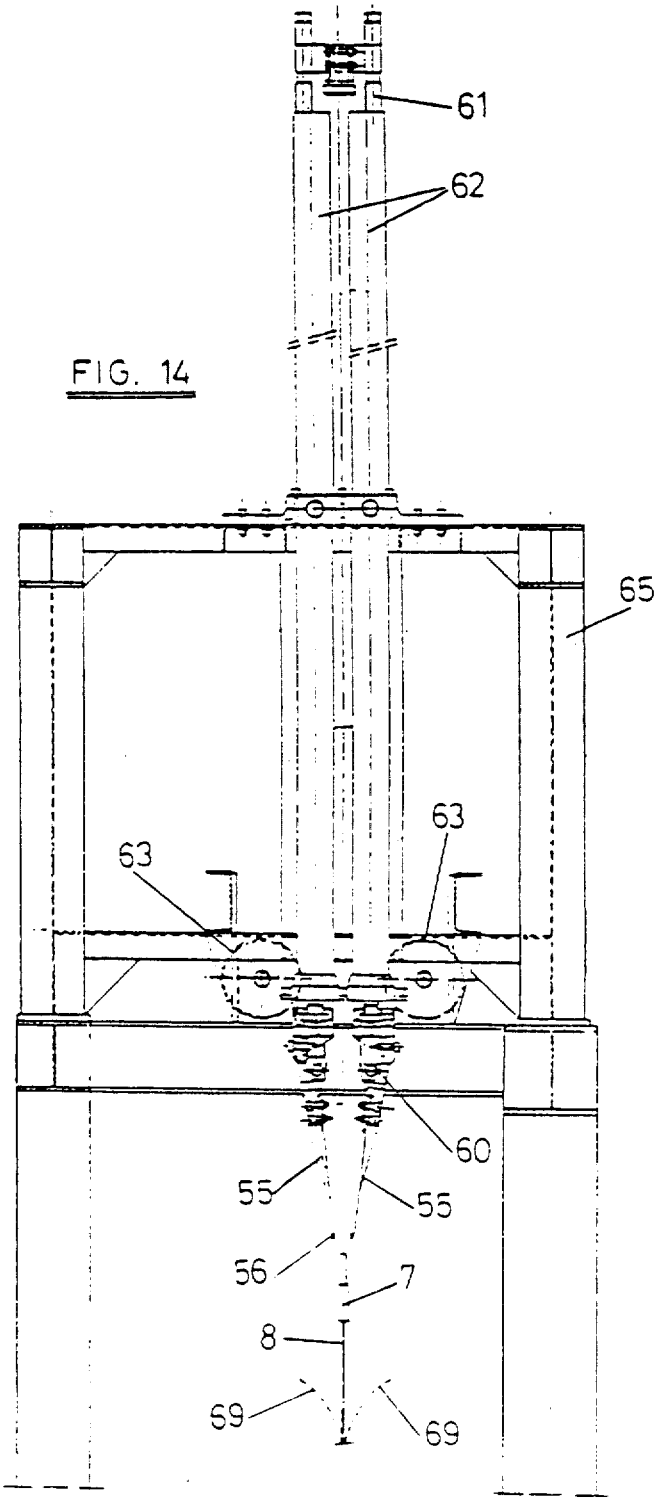
FIG. 14 is a cross-section along line XIV—XIV of FIG. 12.

As can be seen in FIGS. 12 to 14, the scraping device 23 includes two blades 55 which, in the rest position, are located above one of the positions occupied by the cathodes 7 in the fixed beams 4 of the scraping zone 2, immediately next to the position occupied by the lateral piercer 22. These blades 55 have an oblique lower edge ending in a rib 56 of circular cross-section. The blades 55 have tabs 57 fixed to their upper part. These tabs penetrate between the pairs of tabs 58 that project from the head 59. The tab 57 is fixed between the tabs 58 by means of a transverse stud that forms an rotating axis. Some of the tabs are seated facing each other 60 and close together to limit the partial swivel angle of the blades 55. The head 59 of each blade is suspended from two lateral guides 61 and from a central vertical hydraulic cylinder 62. The guides 61 consist of a rack that meshes with the toothed wheels 63 mounted on a freely rotating common shaft 64 and which serves to ensure the synchronized displacement of the two guides 61 supporting each head 59.

Both the hydraulic cylinders 62 and the guides 61 are mounted on a structure 65, the guides 61 being mounted via sliding bearings or bushes 66.

The upper ends of the guides 61 carry heads 67 that will rest in the supports 68 in their lower limit position, restricting their travel and, with that, the descent of the blades 55.

When the blades descend they meet the zinc sheets 69 that have been partially removed starting from their upper edges by the scraper previously described. The blades are introduced in this way between the sheets 69 and the cathode 8 in order to cause the total removal of the zinc sheets 69 as the blades are displaced downwards. The swivel angle of the blades 55 means that, as these blades are supported on the zinc sheets 69 to be removed, the rib 56 of the edge of these blades is supported on the surface of the cathode 8 without producing any erosion in them. The lower oblique edge, the path followed by the rib 56, allows the blades 55 to penetrate between the zinc sheets 69 and the cathode 8.

In the scraping zone 2, between the fixed beams that limit that zone, stops can be provided in such a way as to ensure that the zinc sheets removed from the cathodes fall vertically. These can later be gathered by a conveyor belt or by any other means.

FIGS. 15 to 19 show the cathode designed in accordance with this invention.

As can be seen in FIGS. 15 and 16, the cathode consists of an aluminium or aluminium alloy plate with a rectangular shape, referenced with number 70. Fixed to one of its transverse edges is a bar 71 of greater cross-section than the plate and longer than its transverse side. This bar 71 constitutes the head of the cathode and serves to support it in the electrolytic cell, as a current terminal and for manoeuvring the cathode by means of lifting apparatus for which the plate is provided with two rings or hooks 72 in its upper part. The vertical sides of the plate 70 are provided with a coating 73 of dielectric material and will prevent the zinc sheets deposited on the surfaces of the plate 70 of the cathode from joining together along these vertical faces. In this way the deposit of zinc on the cathode forms two sheets that are joined together only by their lower edge around the bottom side of the aluminium plate 70.

In accordance with the invention, the cathode plate 70 has a zone of lesser thickness 74 that begins at one of the vertical sides, FIGS. 17 to 19. These zones are shaped by recesses with matching contours and of equal depth made in the surfaces of these plates. These recesses are referenced with the number 75 and can be made mechanically. The contour of these recesses can be rectangular. The recesses 75 are filled by means of a coating of material that is dielectric and resistent to the acids in the cells. The coating in each recesses forms layers 76 with a thickness equal to the depth of these recesses, and in such a way that the external surface of these layers or coatings are flat and coplanar with the surface of the plate 70. All this can be seen in FIG. 17.

Coinciding with the recesses 75, the plate 70 has a longitudinal slot 77 in its vertical side, through which the coating layers 76 join to form a core 78 whose side 79 is left level with the side of the plate 70 (FIG. 18).

The union of the coating layers 76 at the bottom of the recesses 75 can be achieved by means of an adhesive that would be resistant to acids and to the temperatures reached during the electrolysis process.

The securing or fixing of the layers 76 can be achieved by means of joining these layers via through holes 80 made in the zone of lesser thickness 74. As can also be seen in FIGS. 18 and 19, the recesses 75 could be provided with a longitudinal channel 81 in the side that limits these recesses, in which would be embedded the coating 76, thereby retaining its edges.

Zone 74 containing the recesses has a vertical dimension and is situated at a height such that, when the cathode is placed in the cell, the electrolyte level always lies within the zone 74. FIG. 15 with reference number 82 shows the height reached by the zinc sheet deposited on the plate 70. Lines of points with reference 83 indicate the arms of the lateral piercer, which have flat facing surfaces 84 that can back on to the external surface of the coatings 76, in such a way that, during the advance of these arms, their tapered front meets the edge 86 of the deposited zinc sheet 82, FIG. 17, causing this sheet to be separated from the sheet 1 of the cathode.

Thanks to the existence of the coatings 76, when the arms 83 of the lateral piercer support the cathode, there is no deterioration in them, since as soon as the removal of the zinc sheets 82 starts, the arms 83 can be slightly separated from the surfaces of the cathode plate 70, thereby preventing any erosion occurring on these surfaces and ensuring the virtually indefinite life of these cathodes.

We claim:

1. Installation for removing zinc deposited by electrolysis on aluminum plates used as cathodes in electrolysis cells, which includes a storage zone for cathodes carrying zinc deposited on them, a scraping zone for the zinc on the cathodes, and a storage zone for the cathodes free of zinc, the cathodes being displaceable along the three stated zones occupying successive parallel positions; the scraping zone including a lateral piercer for separating the upper edge of zinc sheets from the cathode, and a scraping device for the complete removal of these sheets; said lateral piercer consisting of two horizontal parallel arms close to each other and horizontally displaceable, located in a position facing one of the positions occupied by the cathodes in the scraping zone, one on each side of the cathode, with the upper edge at a height above that of the zinc deposits, these arms having a tapered vertical front edge; the scraping device also consisting of two vertical blades located immediately next to the piercer in a position facing one of the positions occupied by the cathodes in the scraping zone, one on each side of the cathode, these blades being vertically displaceable between an upper position, in which they are located above scraping zone, and a lower position located approximately at the height of the lower edge of the cathodes;

characterized in that each one of the storage and scraping zones includes two fixed beams and two movable beams of equal length, with the fixed beams running above each zone in a horizontal and parallel position and located at the same height, separated between each other by a distance slightly greater than the width of the cathode plates, and the movable beams externally backing on to the fixed beams and linked to these by a driving means, the beams being provided with upper equidistant facing notches, of such a size as to receive the ends of the cathode heads;

the movable beams being displaceable alternatively in the same direction with a combined vertical and longitudinal movement, in the vertical direction through a distance slightly greater than the height of the notches and in the longitudinal direction through a distance equal to the distance between consecutive notches, so that the cathode supported on the fixed beams can be displaced sequentially; and in that the lateral piercer arms are mounted on a table that includes longitudinal guides for guiding the displacement of the blades, adjustable stops for fixing the separation between the arms at the start of the displacement, and means for varying this separation during displacement of the arms; and in that the vertical blades of the scraping device are suspended by horizontal shaft links allowing the partial free swivelling of these blades, from two heads that are connected to the lower end of other actuating upper vertical hydraulic cylinders and by upper vertical guides that ensure the uniform displacement of the table, wherein said table carrying the lateral piercer arms includes a platform on which are mounted two longitudinal strips and two lateral rollers that act as external guides limiting the maximum separation of the piercer arms, a central rear hydraulic cylinder responsible for the longitudinal displacement of the arms and a forward support on which are mounted the stops that fix the initial separation of the arms and the means for varying this separation; the cylinder being connected to the arms via a head that rests on the platform and having below it a central protuberance housed in a central longitudinal channel in the platform and which can be displaced along the channel;

the forward support consists of a plate fitted in an upper transverse cavity in the forward part of the platform; the upper part of this plate having two intermediate slots containing two centralizers supporting the arms of the piercer and within which they can slide;

each centralizer having an freely rotating upper separating roller with a vertical axis, supported on internal longitudinal tracks formed in the piercer arms and which tend to separate those arms; the plate and the centralizers being positioned elastically in a direction transverse to the advance of the arms by means of compression springs; this plate also being fitted with two wings in its upper extremes, these wings being located outside the piercer arms and parallel to them;

each wing carrying a hydraulic cylinder acting on a lever or rod that is linked at one end to the plate and carrying on its opposite end an approximator roller supported on the outside by the adjacent arm of the piercer, the approximator of one side and the other driving the piercer arms in a direction opposite to the separator rollers.

2. Installation according to claim 1, characterized in fact that the plate's intermediate slots are separated from each other in the direction of movement of the piercer arms, and partially overlapped in the direction perpendicular to the movement of those arms; the centralizers consisting of flat pieces of height equal to that of the slots and of length slightly less; each of said flat pieces carrying, on its upper surface, a separator roller which is driven towards the arm supporting this roller by means of a compression spring perpendicular to the arms mounted between the centralizer and the wall of the slot.

3. Installation according to claim 1, characterized in that the plate constituting the forward support has threaded passage drill-holes through its transverse sides, each one of which opens out into one of the slots in that plate and receives a threaded rod that partially projects into the slots in order to define the adjustable exterior stop for the centralizers, with the aim of limiting the maximum approach between the piercer arms.

* * * * *